United States Patent [19]

Gonzalez

[11] 4,270,662

[45] Jun. 2, 1981

[54] MODULAR BOTTLE SUPPORT RACK

[76] Inventor: Jesus C. Gonzalez, Parque de San Francisco, 3 Burgos, Spain

[21] Appl. No.: 931,352

[22] Filed: Aug. 7, 1978

[30] Foreign Application Priority Data

Aug. 8, 1977 [ES] Spain ..... 230325

[51] Int. Cl.[3] ..... A47B 73/00

[52] U.S. Cl. ..... 211/74; 211/85; 211/186; 211/188; 211/189; 211/194; D7/71

[58] Field of Search ..... 211/60 R, 74, 85, 49 R, 211/186, 188, 189, 194; 248/49, 68 CB; D7/71; 206/427, 429; 46/26, 31

[56] References Cited

U.S. PATENT DOCUMENTS

| | | | |
|---|---|---|---|
| D. 230,932 | 3/1974 | Izumi | D7/71 |
| 1,821,234 | 9/1931 | Parker | 248/49 |
| 3,160,278 | 12/1964 | Varkala | 211/85 X |
| 3,437,297 | 4/1969 | Jirka et al. | 248/68 CB |
| 3,523,667 | 8/1970 | Guerrero | 248/49 |
| 3,746,178 | 7/1973 | Wagschal | 211/74 |
| 3,870,155 | 3/1975 | Galloway | 211/74 |
| 3,951,259 | 4/1976 | Oglesbee | 206/427 X |
| 4,093,076 | 6/1978 | Newton | 211/189 X |
| 4,095,698 | 6/1978 | Wright | 211/189 X |
| 4,099,626 | 7/1978 | Magnussen | 211/60 R |

FOREIGN PATENT DOCUMENTS

| | | | |
|---|---|---|---|
| 2001630 | 1/1971 | Fed. Rep. of Germany | 248/68 CB |
| 20492 | of 1896 | United Kingdom | 211/74 |
| 1205519 | 8/1970 | United Kingdom | 211/74 |
| 1249387 | 10/1971 | United Kingdom | 211/74 |

*Primary Examiner*—Thomas J. Holko

*Attorney, Agent, or Firm*—Blum, Kaplan, Friedman, Silberman and Beran

[57] ABSTRACT

A modular bottle support rack fabricated of identical modular members using any number of such members in pairs. Each member has a bottle craddling surface and a projecting member which mates with a modular member to provide a pair of spaced bottle craddling surfaces. There is no limit on the number of modular members that can be connected together to form a bottle support rack.

8 Claims, 8 Drawing Figures

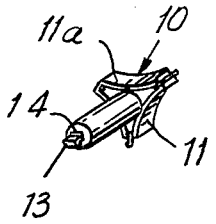
FIG. 1
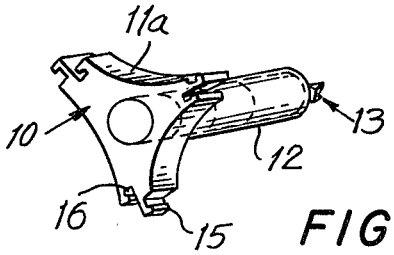
FIG. 2
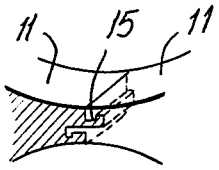
FIG. 3
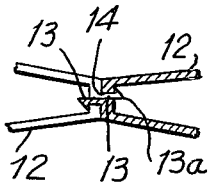
FIG. 4
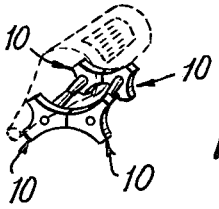
FIG. 5
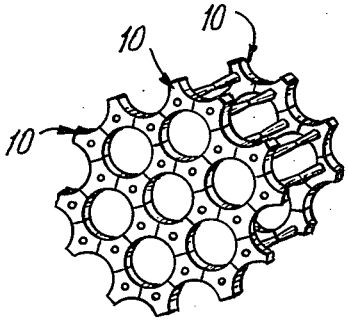
FIG. 6
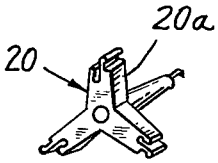
FIG. 7
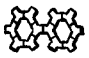
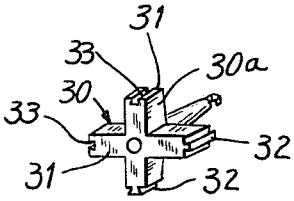
FIG. 8
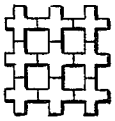

MODULAR BOTTLE SUPPORT RACK

BACKGROUND OF THE INVENTION

Bottle support racks sometimes known as wine racks are commonly available and it is known to provide such racks in knocked down fashion for assembly by the user. Such racks generally have a finite array for assembly of the components and/or have a number of different components of different configurations which must be assembled in order to complete the support rack.

SUMMARY OF THE INVENTION

Generally speaking, in accordance with the invention, a bottle support rack of almost limitless size and configuration can be assembled to hold any desired number of bottles using a single modular element or member. The single member has at least one and preferably multiple surfaces for craddling a bottle as well as a projection for mating with a like projection. The portion carrying the bottle craddling surface interconnects with other portions of identical construction so as to permit an almost limitless assembly of the component parts.

The present application is concerned with a modular bottle support rack which is obtained by a coupling system wherein all of the pieces are identical. In other words, only a single part of a single configuration and geometry is required and multiple elements can be connected together in an almost infinite number to produce substantially any desired geometric shape. The various component parts can be assembled and disconnected so that an assembled rack can be reassembled to another configuration if desired. Thus, for example, a rack having an overall rectangular shape can be changed into one with an overall hexagonal shape by merely rearranging the modular elements. The user can assemble the overall configuration to the individuals' desires, preferences and needs.

As a result of the use of a single modular element, the system can be economically produced and it also can be disassembled, packed and shipped in the smallest possible container.

The materials from which the modular elements are formed are likewise almost limitless although it is likely that a preferred material will be plastic so that the parts can be readily molded using known molding techniques.

Accordingly, it is an object of this invention to provide an improved modular bottle support rack having great versatility.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing, in which:

FIG. 1 is a perspective view of a modular member viewed with the projecting member facing forward;

FIG. 2 is a perspective view of the part of FIG. 1 with the projecting member facing rearward;

FIG. 3 is a partial perspective view of an arrangement for interconnecting adjacent component parts;

FIG. 4 is a partial sectional view showing a means of interconnecting the projecting members;

FIG. 5 is a perspective view of a simple assembly of four identical modular members showing a bottle craddled therein in phantom lines;

FIG. 6 is a perspective view of a modular bottle support rack assembled from a plurality of the components shown in FIGS. 1 through 5;

FIG. 7 is a perspective view of a modular component of modified configuration with a schematic showing of an assembly of such embodiment; and FIG. 8 is a perspective view of a modular component of another modified configuration with a schematic showing of an assembly of such embodiment.

DESCRIPTION OF THE PREFERRED EMBODIMENTS

The present application is concerned with a modular bottle support rack that is obtained by assembling various identical parts of geometric configuration. With the elements of the invention, it is possible to assemble and disassemble the bottle support rack as many times as is desired for transportation, shipping, storage and the like. The special features of the invention makes it possible to enlarge or reduce the size of the bottle support rack or change its shape as desired.

Referring now to the drawing and especially FIGS. 1 and 2, a modular member indicated generally at 10 includes a first portion 11 carrying a plurality of bottle craddling surfaces 11*a*. In the embodiment shown in FIGS. 1 and 2, the bottle craddling surfaces 11*a* are a segment of a circle and the first portion of FIGS. 1 and 2 carries three bottle craddling surfaces 11*a*. Projecting from first portion 11 is a second portion 12 defining a projecting member. The projecting member may be molded integrally with first portion 11 or the first and second portions may be formed separately and then permanently interconnected. The end of second portion 12 remote from its connection with first portion 11 is provided with latching means 13 shown in detail in FIG. 4. Each second portion 12 is provided with a barbed finger 13*a* which is received in a mating hole 14 in an adjacent projecting member. In this manner, two projecting members may be interconnected.

As aforenoted, the modular member of FIGS. 1 and 2 is provided with three bottle craddling surfaces 11*a*. At the intersection of each pair of bottle craddling surfaces, the member is provided with a connecting member in the form of a tongue 15 and a groove 16 for interconnecting a pair of first portions 11 as best shown in FIG. 3.

By interconnecting four modular members 10, a bottle support rack is constructed as shown in FIG. 5. By adding on numerous additional modular members 10, a bottle support rack of the configuration shown in FIG. 6 may be created. The modular members are utilized in pairs interconnected through projecting members 12 and an almost infinite number can be assembled together to provide bottle support racks having almost any desired configuration.

FIG. 7 shows a modular member 20 which differs from that shown in FIG. 2 in that the bottle craddling surface 20*a* is V-shaped rather than curved. A support rack assembled of a number of modular members 20 is also shown in FIG. 7.

A modular member 30 of another configuration is shown in FIG. 8. In this embodiment, there are four bottle craddling surfaces 38, each defined by a pair of surfaces which intersect at right angles. Because of the four craddling surfaces, four connecting members 31 are provided, two of which carry tongues 32 and two of which carry grooves 33. A typical rack capable of assembly with the modular member 30 is shown in FIG. 8. It is noted with respect to the embodiment of FIG. 8 that a rack for the support of a single bottle with two spaced bottle craddling surfaces could be assembled using only two of the modular members 30.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A modular support rack comprising at least two coupled identical members, each said member having:

a first portion, each said first portion includes a plurality of circumferentially spaced bottle craddling surfaces and a plurality of first portion connecting members circumferentially and symmetrically spaced on said first portion, each said connecting member being intermediate a pair of bottle craddling surfaces, a second portion extending from said first portion and forming a projecting member, said projecting member extending from the center of said symmetrical spacing and being symmetrically positioned relative to said craddling surfaces and said first portion connecting members; and latching means, each said projecting member having latching means at its extended end for joining together with the projecting member of another of said at least two identical modular members whereby to form a pair of spaced bottle craddling surfaces from each coupled pair for supporting a bottle at spaced intervals along the bottle surface.

2. A modular bottle support rack as claimed in claim 1 wherein each said first portion includes three bottle craddling surfaces and three connecting members.

3. A modular bottle support rack as claimed in claim 2 wherein said rack includes at least twelve identical modular members, a first six being connected together in a circular array through said first portion connecting members, a second six being connected together in a circular array through said first portion connecting members, and said first and second sets of six being joined by said latching means.

4. A modular bottle support rack as claimed in claim 2 wherein said rack includes at least eight identical modular members, a first four being connected together in a circular array through said first portion connecting members, a second four being connected together in a circular array through said first portion connecting members, and said first and second sets of four being joined by said latching means.

5. A modular bottle support rack as claimed in claim 2 wherein each bottle craddling surface is a concave portion of a circle.

6. A modular bottle support rack as claimed in claim 2 wherein each bottle craddling surface is defined by two surfaces mating at an angle in excess of ninety degrees.

7. A modular bottle support rack as claimed in claim 1 wherein each said first portion includes four bottle craddling surfaces and four connecting members.

8. A modular bottle support rack as claimed in claim 7 wherein each bottle craddling surface is formed by two surfaces meeting at right angles.

* * * * *